United States Patent [19]

Eglinton

[11] 4,208,790

[45] Jun. 24, 1980

[54] ROLL END PROTECTION

[75] Inventor: Robert B. Eglinton, Huntington Beach, Calif.

[73] Assignee: Chromalloy American Corporation, New York, N.Y.

[21] Appl. No.: 951,478

[22] Filed: Oct. 16, 1978

[51] Int. Cl.[2] ..... B65D 85/67; B23P 11/00; B25B 11/00

[52] U.S. Cl. ..... 29/798; 29/281.1; 29/432; 206/413; 206/415

[58] Field of Search ..... 206/413, 414, 415, 408, 206/389; 242/68.6; 29/798, 281.1, 432

[56] References Cited

U.S. PATENT DOCUMENTS

| | | | |
|---|---|---|---|
| 932,808 | 8/1909 | Pelton | 206/415 |
| 1,809,267 | 6/1931 | Cushing | 242/68.6 |
| 3,685,644 | 8/1972 | Cothran et al. | 206/408 |

*Primary Examiner*—William T. Dixson, Jr.
*Attorney, Agent, or Firm*—William W. Haefliger

[57] ABSTRACT

A device to protect the end of a roll of material wrapped about a tubular core includes a protective annular body to be located in position proximate the roll end, and at least one prong located on the body to be inserted relatively endwise into the core interior when the annular body is located in its protective position. The prong has a tip angled to penetrate the core when deflected toward the core bore, thereby attaching the body to the core.

17 Claims, 8 Drawing Figures

FIG. 1.
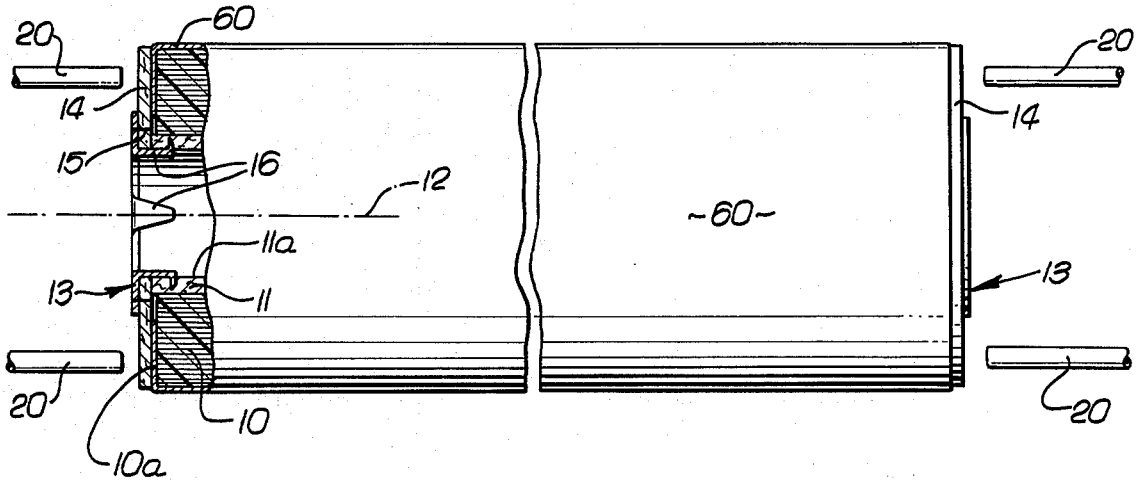
FIG. 2.
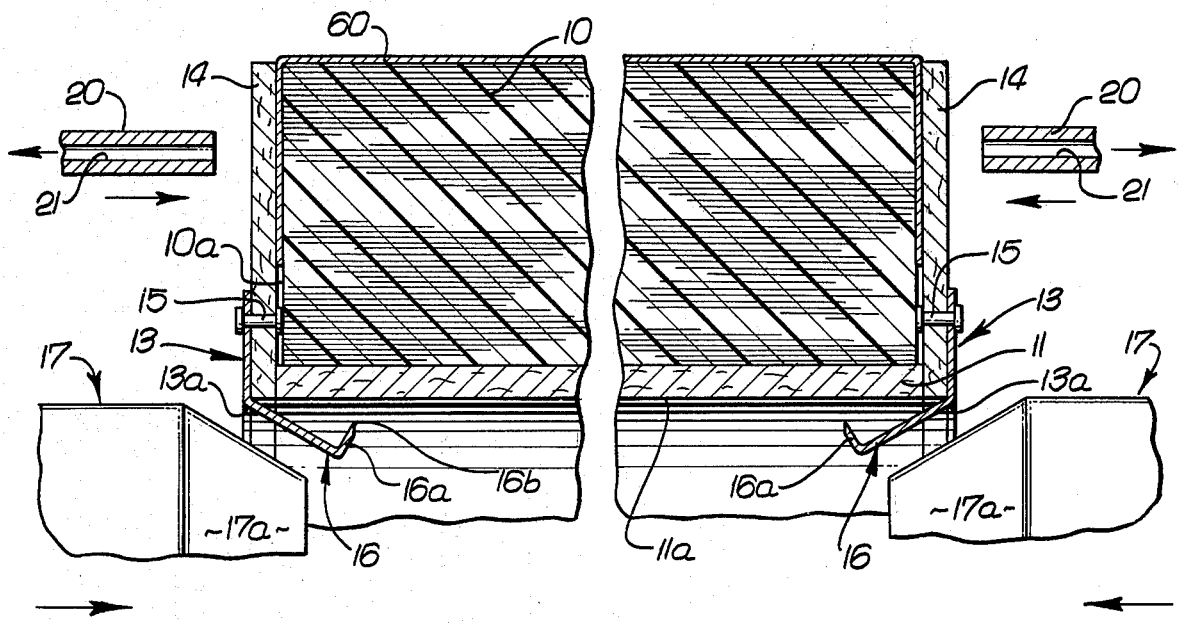
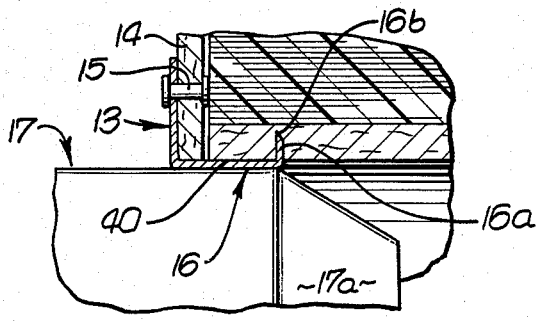
FIG. 2a.

ROLL END PROTECTION

BACKGROUND OF THE INVENTION

This invention relates generally to the protection of rolls of material, and more particularly concerns protecting the edges of thin sheet material rolled on cores.

Thin sheet material, as for example vinyl sheets, when rolled on cores for shipment or other handling requires edge protection at the ends of the roll to prevent damage. In the past, such protection was provided by manually extending an elongated fastener such as the shaft of a bolt through the core, and manually connecting the ends of the bolt to protective retainers at opposite ends of the roll. This procedure is time consuming and labor intensive, and consequently is not well suited to the automated, high volume, high speed packaging of this sheet material.

SUMMARY OF THE INVENTION

It is a major object of the invention to provide a solution to the above packaging problem, and also to provide positive connection of a protective retainer device at the end of the sheet roll. Basically, the invention is embodied in a device that comprises:

(a) an annular body sized to be located in protective position proximate said roll end, and (b) at least one prong having attachment to the body to be inserted relatively endwise into the core interior when the annular body is located in said position, (c) said prong having a tip angled to penetrate the core when the prong is deflected toward the core bore whereby the device then becomes attached to the core with the annular body in said position.

As will appear, a flange or disc, typically non-metallic, may be attached to or otherwise made integral with the body to project radially outwardly to the periphery of the roll end, the flange being annular and having a central opening to pass a tool that deflects the prong toward the core bore; at least two and preferably 3–5 prongs may be provided and spaced about the body axis; each prong may have a metallic main planar section one end of which is attached to the body, and the prong tip at the opposite end of the section typically projects at an angle and toward the core bore; also, two such devices may be simultaneously applied to opposite ends of the core by automated tooling, after which rams may be carried to enter the core bore at its opposite ends to deflect the prongs into connected relation with the core, whereby the invention is seen to facilitate automated protection of roll ends.

These and other objects and advantages of the invention, as well as the details of an illustrative embodiment, will be more fully understood from the following description and drawings, in which:

DRAWING DESCRIPTION

FIG. 1 is an elevation showing a roll of material to which the invention is applicable;

FIG. 2 is an enlarged elevation, taken in section, in elevation, showing details of roll end protection in accordance with the invention;

Figure 3:
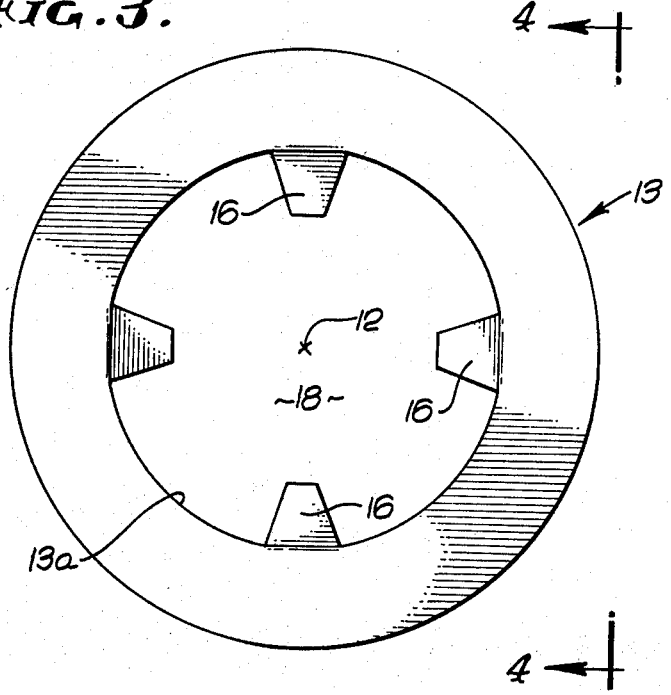
Figure 4:
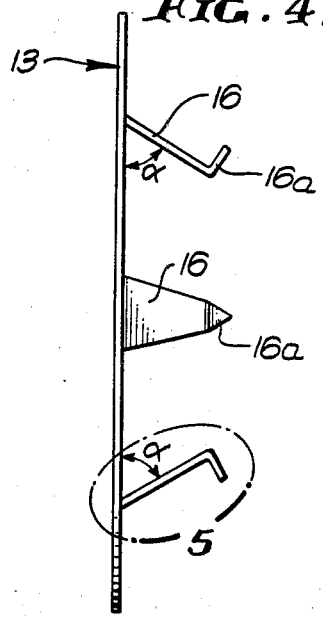
Figure 5:
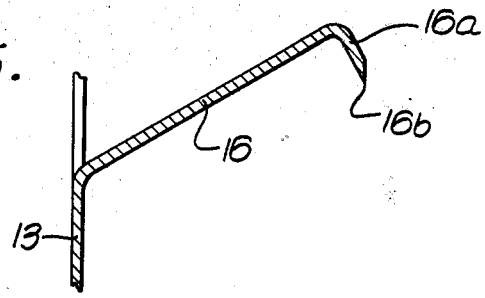
Figure 6:
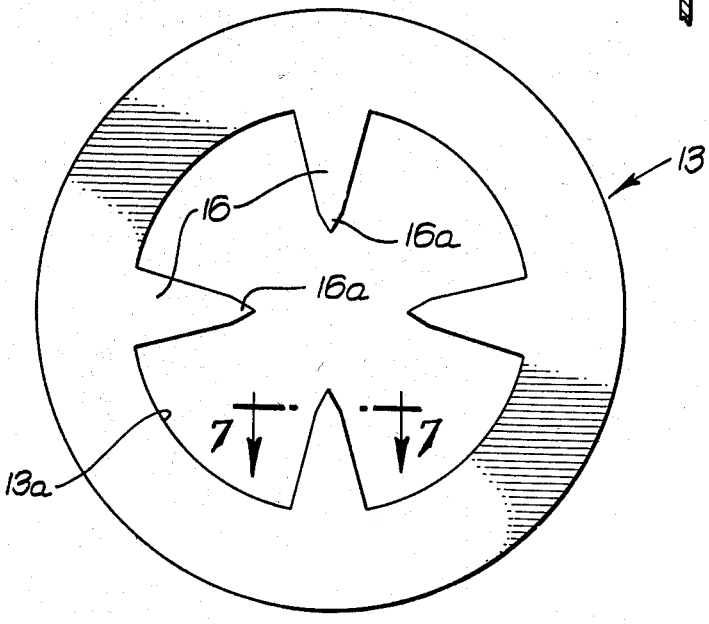
Figure 7:
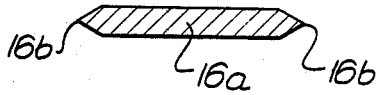

FIG. 2*a* is a fragmentary view showing prong penetration of the core of the roll;

FIG. 3 is an enlarged frontal elevation of a protector body or cap;

FIG. 4 is a side elevation of the FIG. 3 body or cap;

FIG. 5 is an enlarged section showing details of a prong portion of the FIGS. 3 and 4 body or cap;

FIG. 6 is a view like FIG. 3, showing a flat pattern form of the cap; and FIG. 7 is an enlarged section on lines 7—7 of FIG. 6.

DETAILED DESCRIPTION

In FIGS. 1 and 2, a roll of material is shown at 10 wrapped on a tubular core 11 which extends axially through the roll. The latter may for example consist of sheet vinyl material, the edges 10*a* of which require protection as during shipment. The core, which may consist of pasteboard, wood, or other non-metallic material, has a bore 11*a* which extends about central axis 12. In addition, a Kraft paper or other wrapping may extend about the roll, and at its opposite ends, as indicated at 60.

In accordance with the invention, and extending the description of FIGS. 3–6, a protective device which includes an annular body or cap 13 is provided and sized to be located in protective position adjacent the roll end, and typically two such bodies are respectively located at opposite ends of the roll as shown. In addition, an annular flange or disc 14 is provided for association with each body 13, the two typically being integrally connected as by fasteners 15 spaced about axis 12. The flange or disc 14 extends coaxially with body 13, and projects radially outwardly from the core to a point beyond the body periphery to extend or fit closely adjacent the entirety of the roll end, as is clear from FIG. 2. Accordingly, the non-metallic flange or disc acts to protect the spiral edge of the sheet wrapped on the core, at the roll end, and it is in turn mounted to the inner side of the body or cap 13 which is typically metallic and may consist of a thin steel stamping.

Further in accordance with the invention, at least one prong or tab 16 has integral (or other) attachment to the body 13, to project from the inner annular edge 13*a* of the body annulus as seen in FIGS. 3–6. Typically two or more such prongs may be provided and spaced about axis 12, four being shown and as being integral with the body stamping. Each prong is adapted to be inserted relatively endwise into the core interior, at the core end, when or after the annular body is located in protective position proximate the roll end, with the flange 14 adjacent that end. The prong has a tip 16*a* angled to penetrate the core when the prong is deflected radially outwardly away from axis 12, as is better seen in FIG. 2*a*. In FIG. 5 the prong tip 16*a* is sharpened at 16*b* to aid in such penetration, which may be effected by a pusher or ram 17 displaced coaxially into the core bore interior with sufficient clearance from the bore to displace or bend the prong as shown. The ram may have a tapered end 17*a* as shown to aid in such progressive outward displacement of the prong or prongs as the ram moves into the core. After retraction of the ram, each prong remains in the position shown in FIG. 2*a*, attached to the core and holding the body 13 and flange 14 in the roll end protective position seen in FIG. 2.

FIG. 3 also shows the body 13 to define a central opening 18 to pass the ram, and FIG. 4 shows the prongs initially projecting out of the plane of body 14, at angles $\alpha$ therefrom, $\alpha$ being between 20° and 70°, preferably. This also permits the angled junctions of the prongs with the body to act as centering guides to coaxially center the body relative to the roll. Turned tip 16*a* typically extends at about 90° from the plane of the prong main extent. Each prong is typically tapered toward its tip, and may consist of flat steel stock, stamped out with body 13. The tip edges are sharp as appears in FIG. 7.

The method of protecting the end of a roll of material using the device of FIGS. 3–6 includes the following steps:

(a) applying the body 13 to one end of the roll so that the prong 16 enters the core interior, and (b) deflecting the prong toward and into adjacency to the bore of the core so that the tip 16*a* then penetrates into the core to hold these body firmly to the core and roll.

A like device may be similarly applied to the opposite end of the roll, and both devices may be simultaneously applied to the opposite ends of the roll and the prongs simultaneously deflected as by rams 17. In addition, holders 20 may be applied to the discs 14 to hold them against the roll ends while the ram are advanced to deflect the prongs. Holders 20 may also take the form of suction applicators to apply the discs to the roll ends in the first instance. Note suction passages 21 in the applicators.

When it is desired to remove the roll end protection devices, the prongs can easily be dislodged from the core by inserting a tool such as a screw driver into the core end and between the prong main extent and the core, at location 40. The prong can then be quickly pried loose.

I claim:

1. In a device to protect the end of a roll of material wrapped about a tubular core having a bore, (a) an annular body sized to be located in protective position proximate said roll end, and (b) at least one prong having attachment to the body to be inserted relatively endwise into the core interior when the annular body is located in said position, (c) said prong having a tip at the end portion of the prong furthest from the body and angled to extend at the outer side of the prong to penetrate the core when the prong is deflected toward the core bore whereby the device then becomes attached to the core with the annular body in said position, the prong being free of any projection at its inner side opposite said outer side.

2. The device of claim 1 including a flange integral with said body and projecting radially outwardly therefrom to extend adjacent the periphery of the roll end, in protective relation therewith.

3. The device of claim 2 wherein said flange is annular and has a central opening, said prong extending through said opening, said prong attachment located at one side of said opening, said body attached to the flange in spaced relation to the prong.

4. The device of claim 3 including at least one additional prong, like said first mentioned prong, having attachment to said body, said prongs spaced about a central axis defined by said annular body.

5. The device of claim 4 wherein there are four of said prongs spaced about said axis.

6. The device of claim 4 wherein each of said prongs has a metallic main planar section one end of which has said attachment to the radially inner periphery of said body, each prong tip being metallic and projecting out of the plane of said main section.

7. The device of claim 6 including fasteners attaching the flange to said body and projecting radially outwardly of said prongs to extend adjacent the periphery of the roll end, in protective relation therewith.

8. The device of claim 7 wherein said flange is nonmetallic, has disc shape, and is attached to said body.

9. The device of claim 1, and including said roll of material, said prong received into the core interior.

10. The device of claim 7 including said roll of material, said prongs received endwise into the core interior.

11. The device of claim 10 wherein said material consists of vinyl sheet material.

12. The device of claim 10 including a second device like the first mentioned device, said devices located at opposite ends of the roll core, the prongs of the second device also received into the core interior.

13. The device of claim 10 wherein said device prongs are deflected outwardly into close adjacency to the core bore, said tips penetrating into the core to retain the devices to the core with said flanges retained in close protective adjacency to the opposite ends of the roll.

14. In apparatus for protecting the end of a roll of material wrapped about a tubular core, and operable upon a device that comprises (a) an annular body sized to be located in protective position proximate said roll end, and (b) at least one prong having attachment to the body to be inserted relatively endwise into the core interior when the annular body is located in said position, (c) said prong having a tip at the end portion of the prong furthest from the body and angled to extend at the outer side of the prong to penetrate the core when the prong is deflected toward the core bore whereby the device then becomes attached to the core with the annular body is in said position, the prong being free of any projection at its inner side opposite said outer side, the combination that includes:

(d) a holder for applying said body to one end of the roll so that said prong enters the core interior, and (e) a pusher located to penetrate through the body and to deflect the prong toward and into adjacency with the core bore so that said tip then penetrates into the core.

15. The apparatus of claim 14 wherein said apparatus includes actuator means operatively connected with said holder and pusher.

16. The apparatus of claim 15 wherein said holder includes a suction applicator sized to controllably apply suction to said body.

17. The apparatus of claim 15 including a second holder and a second pusher like said first mentioned holder and pusher but located at the opposite end of the roll so that both said devices may be simultaneously applied to opposite ends of the roll, and said prongs may be deflected as defined, and actuator means operatively connected with said second holder and pusher.

* * * * *